US008985793B2

(12) United States Patent
Osaki et al.

(10) Patent No.: US 8,985,793 B2
(45) Date of Patent: Mar. 24, 2015

(54) ILLUMINATION DEVICE

(75) Inventors: Shinji Osaki, Osaka (JP); Toyonori Uemura, Osaka (JP); Toshio Hata, Osaka (JP); Junichi Somei, Osaka (JP); Yuji Kozuma, Osaka (JP); Kenji Hatazawa, Osaka (JP); Tomokazu Nada, Osaka (JP); Makoto Agatani, Osaka (JP); Shinya Ishizaki, Osaka (JP); Tatsuya Morioka, Osaka (JP); Makoto Matsuda, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 161 days.

(21) Appl. No.: 13/813,520

(22) PCT Filed: Jun. 27, 2011

(86) PCT No.: PCT/JP2011/064638
§ 371 (c)(1),
(2), (4) Date: Jan. 31, 2013

(87) PCT Pub. No.: WO2012/017754

PCT Pub. Date: Feb. 9, 2012

(65) Prior Publication Data

US 2013/0128493 A1 May 23, 2013

(30) Foreign Application Priority Data

Aug. 2, 2010 (JP) ..... 2010-173399

(51) Int. Cl.
*F21V 14/08* (2006.01)
*F21V 14/00* (2006.01)
(Continued)

(52) U.S. Cl.
CPC ..... *F21V 14/08* (2013.01); *F21K 9/135* (2013.01); *F21K 9/56* (2013.01); *F21S 10/02* (2013.01);
(Continued)

(58) Field of Classification Search
USPC ..... 257/88, 89, 99, E33.061; 362/84, 362/249.01, 249.02
See application file for complete search history.

(56) References Cited

U.S. PATENT DOCUMENTS 6,474,837 B1 11/2002 Belliveau
6,686,691 B1 * 2/2004 Mueller et al. ..... 313/503
(Continued)

FOREIGN PATENT DOCUMENTS

JP 3-246803 11/1991
JP 4-248204 9/1992
(Continued)

OTHER PUBLICATIONS

International Search Report for PCT/JP2011/064638 mailed Sep. 20, 2011.

*Primary Examiner* — Elmito Breval
(74) *Attorney, Agent, or Firm* — Nixon & Vanderhye, P.C.

(57) ABSTRACT

An illumination device with a toning function in which possibility of moisture and dust intruding into the case is reduced with a simple mechanism is realized. The illumination device includes a light emitting element light source (17) mounted on a substrate inside the case unit (21), an external gear-shaped fluorescent-substance plate (41) having a configuration in which a light emitting color of an applied fluorescent substance differs according to position and being arranged above the light emitting element light source (17) inside the case unit (21), and an internal gear-shaped adjustment ring (43) arranged so as to mesh with the external teeth of the fluorescent-substance plate (41), wherein the adjustment ring (43) is arranged to be positioned on the outer periphery of the main body under a lens dome (11), and when the adjustment ring (43) is rotated, a relative positional relationship between a color distribution applied on the fluorescent-substance plate (41) and the light emitting element light source (17) is changed.

3 Claims, 9 Drawing Sheets

(51) Int. Cl.

| | |
|---|---|
| ***F21K 99/00*** | (2010.01) |
| ***F21S 10/02*** | (2006.01) |
| ***F21V 3/02*** | (2006.01) |
| ***F21V 9/10*** | (2006.01) |
| *F21Y 101/02* | (2006.01) |
| *F21Y 105/00* | (2006.01) |

(52) U.S. Cl.

CPC ... *F21V 3/02* (2013.01); *F21V 9/10* (2013.01); *F21Y 2101/02* (2013.01); *F21V 14/006* (2013.01); *F21K 9/58* (2013.01); *F21Y 2105/001* (2013.01)

USPC ..... 362/84; 362/249.01; 362/249.02; 257/89; 257/88; 257/E33.061

(56) References Cited

U.S. PATENT DOCUMENTS

| | | | | |
|---|---|---|---|---|
| 2003/0067775 | A1* | 4/2003 | Nagai et al. | 362/240 |
| 2008/0316746 | A1 | 12/2008 | Belliveau et al. | |
| 2009/0196043 | A1 | 8/2009 | Calmes | |
| 2009/0251915 | A1* | 10/2009 | Boroczki et al. | 362/512 |
| 2009/0290351 | A1* | 11/2009 | Chan | 362/277 |
| 2011/0006688 | A1* | 1/2011 | Shim | 315/119 |
| 2011/0128718 | A1* | 6/2011 | Ramer et al. | 362/84 |

FOREIGN PATENT DOCUMENTS

| | | |
|---|---|---|
| JP | 2007-59260 | 3/2007 |
| WO | WO 2008/149250 | 12/2008 |

* cited by examiner

ILLUMINATION DEVICE

This application is a National phase filing under 35 U.S.C. §371 of International Application No. PCT/JP2011/064638 filed on 27 Jun. 2011, and which claims priority to Japanese Application No. 2010-173399 filed on Aug. 2, 2010, the entire contents of each of which are hereby incorporated by reference.

TECHNICAL FIELD

The present invention relates to an illumination device that use a semiconductor light emitting element such as a light emitting diode (hereinafter appropriately abbreviated as "LED") as a light source, and in particular, to an illumination device having a dimming function.

BACKGROUND ART

In recent years, the LED is frequently used for the light source of the illumination device. In the illumination device using the LED, one of the methods of obtaining white light is a method that uses three types of LEDs, a red LED, a blue LED, and a green LED.

However, the manufacturing cost increases with such a method since three types of LED element are required. Thus, an illumination device capable of irradiating white light with one type of LED element has been developed.

FIGS. 8A and 8B are schematic views showing one example of an LED illumination device disclosed in Patent Document 1 listed below, where FIG. 8A shows a front view and FIG. 8B shows a partially cutout plan view.

A conventional illumination device 101 shown in FIGS. 8A and 8B has a rotation plate 102 arranged above an LED element (light emitting element) 105. The rotation plate 102 has a plurality of circular through-holes radially arranged at equal intervals, and fluorescent-substance sheets 103 having different colors are each fitted into the through-holes. In the example of Patent Document 1, blue, green, yellow, orange, and red fluorescent-substance sheets are provided.

The rotation plate 102 has one portion projecting out to an outer side of a case 106 so as to be manually rotated by a user. The rotation plate 102 is configured to be rotatable by 360° in both clockwise and counterclockwise directions with a shaft 104 as a center.

When the rotation plate 102 is rotated, a relative positional relationship between the LED element 105 and each fluorescent-substance sheet 103 changes, so that the color temperature of the light irradiated from the illumination device can be changed in a stepless manner in the order of "daylight color"→"neutral white color"→"incandescent lamp color" or in the reverse order.

PRIOR ART DOCUMENT

Patent Document

Patent Document 1: Japanese Patent Application Laid-Open Publication No. 2007-059260

SUMMARY OF THE INVENTION

Problems to be Solved by the Invention

In the technique of Patent Document 1, a configuration in which the rotation plate 102 and the fluorescent-substance sheet of each color integrally rotate is adopted. Since the rotation plate 102 projects to the outer side of the case 106, moisture and dust are assumed to be attached to the rotation plate 102. The projecting portion moves inside the case 106 when the rotation plate 102 is rotated, and hence the moisture and dust eventually intrudes into the case 106 and may lower the brightness and degrade the toning function. In order to prevent this, a complex sealing mechanism is to be provided so that moisture and dust do not intrude into the case 106, but this complicates the manufacturing process and increases the manufacturing cost.

In view of the above problems, it is an object of the present invention to realize an illumination device with a toning function in which possibility of moisture and dust intruding into the case is reduced with a simple mechanism.

Means for Solving the Problem

In order to achieve the above object, the present invention provides an illumination device in which a main body is covered with a case unit, the illumination device being characterized by comprising:

a light emitting element light source mounted on a substrate on an inner side of the case unit;

a variable color fluorescent-substance unit having a configuration in which a light emitting color of an applied fluorescent substance differs according to position and being arranged above the light emitting element light source on the inner side of the case unit; and a toning adjusting unit mechanically coupled with the variable color fluorescent-substance unit, wherein the toning adjusting unit is formed such that an end positioned on a side opposite to the variable color fluorescent-substance unit projects to an outer side of the case unit, and is configured such that a relative positional relationship between a color distribution of the fluorescent substance applied on the variable color fluorescent-substance unit and the light emitting element light source is changed when the end is operated.

Moreover, in addition to the above characteristic, the illumination device according to the present invention has another characteristic that the device comprises a dimming unit for adjusting an amount of light actually radiated outside the illumination device with respect to an amount of light radiated from the light emitting element light source; and a dimming adjusting unit mechanically coupled to the dimming unit, wherein the dimming adjusting unit is formed such that an end positioned on a side opposite to the variable color fluorescent-substance unit projects to an outer side of the case unit, and is configured such that a relative positional relationship between the dimming unit and the light emitting element light source is changed when the end is operated.

Moreover, in addition to the above characteristics, the illumination device according to the present invention has another characteristic that the device comprises a plurality of variable color fluorescent-substance units, each corresponding to the variable color fluorescent-substance unit, in which the color distribution of the applied fluorescent substance differs from each other, wherein the variable color fluorescent-substance units are mechanically coupled to different toning adjusting units, respectively, the different toning adjusting units each corresponding to the toning adjusting unit.

More specifically, the illumination device according to the present invention is characterized by including the following configuration. That is, the variable color fluorescent-substance unit includes a fluorescent-substance plate applied with fluorescent substance, and a first gear physically fixed to the fluorescent-substance plate, the first gear being rotatable in a clockwise direction or a counterclockwise direction, and the toning adjusting unit is configured by a second gear which is rotatable in a clockwise direction or a counterclockwise direction, the second gear meshing with the first gear.

Moreover, the illumination device according to the present invention is characterized by including the following another configuration. That is, the variable color fluorescent-substance unit is configured by a plurality of small regions capable of being folded like a folding fan, and the toning adjusting unit has a movable lever-shaped structure, and the folded small regions of the variable fluorescent-substance unit are opened or the opened small regions of the variable fluorescent-substance unit are folded when the toning adjusting unit is moved.

Moreover, the illumination device according to the present invention is characterized by including the following another configuration. That is, the variable color fluorescent-substance unit is a circular plate shaped gear with external teeth, and is configured to rotate on a fixing shaft provided at a center portion in a clockwise direction or a counterclockwise direction, the toning adjusting unit is a circular ring-shaped gear with internal teeth which couples to an outer periphery of the case unit and is rotatable in the clockwise direction or the counterclockwise direction, the variable color fluorescent-substance unit is arranged such that the external teeth mesh with the internal teeth of the toning adjusting unit, and the variable color fluorescent-substance unit rotates when the toning adjusting unit is rotated.

Moreover, the illumination device according to the present invention is characterized by including the following another configuration. That is, the variable color fluorescent-substance unit is configured to have a roll screen shape capable of being wound in both forward and reverse directions on a predetermined surface, and the toning adjusting unit includes a screw which is rotatable in a clockwise direction or a counterclockwise direction, and a winding unit which is arranged on the inner side of the case unit and couples the screw with the variable color fluorescent-substance unit, and the winding unit rotates to perform a winding operation of the variable color fluorescent-substance unit when the screw is rotated.

Effects Of The Invention

According to the configuration of the present invention, the portion applied with the fluorescent substance for realizing the dimming function can be completely accommodated on the inner side of the case unit. Therefore, moisture and dust will not intrude into the fluorescent substance even if a dedicated intrusion preventing member such as the sealing mechanism or the like is not separately arranged. Thus, a situation in which the toning function degrades with the intruding in of the moisture and dust can be avoided while suppressing the manufacturing cost.

MODE FOR CARRYING OUT THE INVENTION

Embodiments of an illumination device of the present invention will be described with reference to the drawings. Each of the embodiments is described with a light source as an LED element, but the light source is not limited to the LED element and other semiconductor light emitting elements may be used. The structure shown in each figure below is merely an example, and various design changes can be made within a scope having similar functions.

[First Embodiment]

Figure 1A:
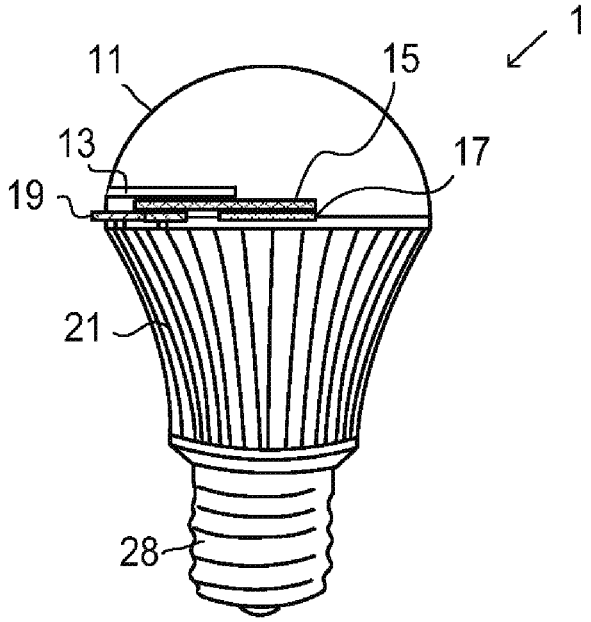
FIGS. 1A and 1B show an LED illumination device according to a first embodiment of the present invention.
Figure 1B:
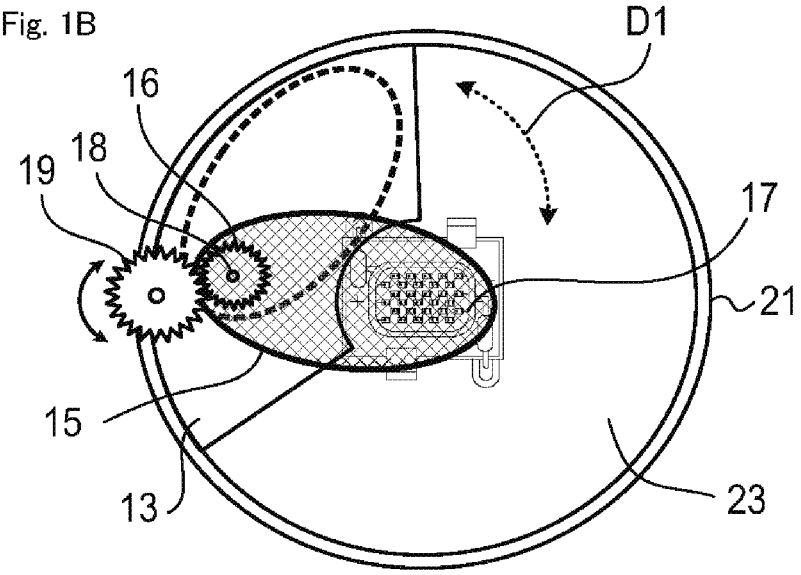

FIGS. 1A and 1B show a schematic structure of an illumination device of a first embodiment. FIG. 1A is a front view and FIG. 1B is a top view of a light source portion.

The illumination device 1 includes a lens dome 11 with a scattering material, a light reflection cover 13, a fluorescent-substance plate 15, a fluorescent-substance plate moving gear 16, an LED light source 17, an adjustment gear 19, a case unit 21, a resin plate 23, and a cap 28. The case unit 21 has a configuration of covering a main body unit, and also serves as a heat dissipating unit in the present embodiment. In both of FIGS. 1A and 1B, all members are not illustrated for the convenience of illustration. The fluorescent-substance plate moving gear 16 corresponds to a "first gear" and the adjustment gear 19 corresponds to a "second gear".

The LED light source 17 (corresponding to "light emitting element light source") is mounted on a ceramic substrate substantially at a central part of the resin plate 23. By way of example, the LED light source 17 is realized by arranging, in parallel, three rows of series circuits, each having twenty blue LED elements connected in series, which size is 15 mm×12 mm. The periphery of the circuit is surrounded with a resin dam, and a translucent resin is filled into the resin dam so as to cover the blue LED elements.

The light reflection cover 13 has a function of preventing attenuation of light in the lens dome 11 and adjusting the light emitting color.

The fluorescent-substance plate moving gear 16 is rotatably movable in a clockwise direction or a counterclockwise direction with a fixing shaft 18 as a center. The gear 16 is physically integrated with the fluorescent-substance plate 15 by the fixing shaft 18. That is, when the gear 16 rotates in the clockwise direction, the fluorescent-substance plate 15 also rotates therewith in the clockwise direction with the fixing shaft 18 as the center, whereas when the gear 16 rotates in the counterclockwise direction, the fluorescent-substance plate 15 also rotates therewith in the counterclockwise direction with the fixing shaft 18 as the center. In the present embodiment, the fluorescent-substance plate 15 and the fluorescent-substance plate moving gear 16 serve as a "variable color fluorescent-substance unit".

The fixing shaft 18 is positioned not at the center position but slightly near the end on the fluorescent-substance plate 15.

The fluorescent-substance plate 15 has a configuration in which the color of the applied fluorescent substance differs according to the position, and the color of the light radiated from the illumination device 1 to the outside changes when the relative positional relationship between the color distribution and the LED light source 17 changes. The fluorescent-substance plate 15 is accommodated on the inner side of the case unit 21, and does not project to the outer side of the case unit 21. In the figure, the fluorescent-substance plate 15 has an oval shape, but the fluorescent-substance plate 15 may have any shape.

The adjustment gear 19 partially projects to the outer side of the case unit 21 so as to be manually operable from the outside. The adjustment gear 19 is arranged such that part of the irregularities thereof meshes with (gears with) part of the irregularities of the fluorescent-substance plate moving gear 16. When the adjustment gear 19 rotates in the clockwise direction or the counterclockwise direction, the meshing position of the both gears shifts and the fluorescent-substance plate moving gear 16 rotates in the direction opposite to the adjustment gear 19. Then, the fluorescent-substance plate 15 also rotates and moves therewith (in direction of arrow D1). The relative positional relationship between the LED light source 17 and the color distribution on the fluorescent-substance plate 15 thus can be changed. In the present embodiment, the adjustment gear 19 serves as a "toning adjusting unit".

The fluorescent-substance plate 15 realizes the change in color distribution according to the position by changing the mixing ratio of the fluorescent substance according to the area. For example, two types of fluorescent substances, $Ca_3(Sr,Mg)2Si_3O_{12}$:Ce (cerium added fluorescent substance) and fluorescent substance $(Sr,Ca)AlSiN_3$:Eu (europium added fluorescent substance) are used, and the mixing ratio thereof is changed to change the light emitting color.

According to another example, the fluorescent-substance plate 15 can be realized by simply increasing/decreasing the content of fluorescent substance in one direction to give gradation. The light emitting efficiency and the brightness of the present illumination device 1 can be adjusted by changing the content of yellow fluorescent substance and changing the fluorescent-substance amount of the fluorescent-substance plate 15 through which the radiated light from the LED light source 17 passes. Similar adjustment may be made by changing the content of the red fluorescent substance and the green fluorescent substance. In this case, adjustment that places a great significance on the color rendering properties may be carried out.

When the adjustment gear 19 is rotated in the clockwise direction in such a state, the relative positional relationship between the LED light source 17 and the color distribution on the fluorescent-substance plate 15 changes, and as a result, the color of light radiated from the illumination device 1 can be changed in the order of "daylight color"→"neutral white color"→"white color"→"incandescent lamp color". Furthermore, when the adjustment gear 19 is rotated in the counterclockwise direction, the color of the radiated light from the illumination device 1 can be changed in the reverse order.

According to the configuration of the present embodiment, since only one portion of the adjustment gear 19 projects to the outside of the case unit 21, moisture and dust are not attached to the surface of the fluorescent-substance plate 15 that realizes the toning function.

Furthermore, only the blue LED element needs to be mounted as the constituent light emitting element of the present embodiment, and the toning function can be realized by manually rotating the adjustment gear 19. Thus, the manufacturing cost is greatly reduced compared to the LED illumination device in which a plurality of LED elements having different light emitting colors are mounted and each LED element electrically adjusts the luminance of the arrangement to realize the dimming and toning function.

When the LED light source is manufactured, the LED element is generally covered with translucent resin containing fluorescent substance, but chromaticity may shift or vary at this time. Even if the chromaticity shifts or varies, the translucent resin cannot be removed to reuse the LED element, and hence a relatively expensive LED element becomes a waste.

As described above, in the case of the illumination device in which a plurality of LED elements having different light emitting colors are mounted and luminance of each LED element is made different to carry out toning, when the chromaticity of each LED element shifts or varies, this directly influences the radiated light from the illumination device. As a result, the device is considered to be defective. On the other hand, in the case of the configuration of the present embodiment, since only the blue LED element is mounted as the light emitting element and the toning function is realized by the fluorescent-substance plate 15, the illumination device that correctly exhibits the toning function can be realized by managing the fluorescent-substance plate 15, and the defective rate of the device can be lowered.

Figure 2A:
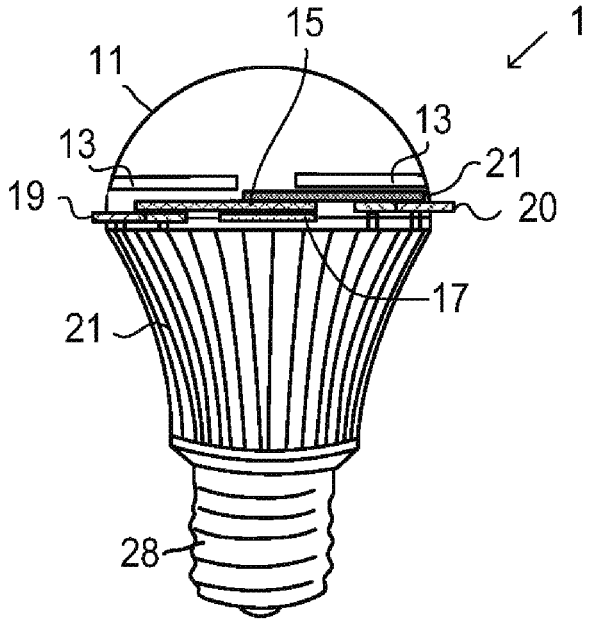
FIGS. 2A and 2B show another configuration example of an LED illumination device according to the first embodiment of the present invention.
Figure 2B:
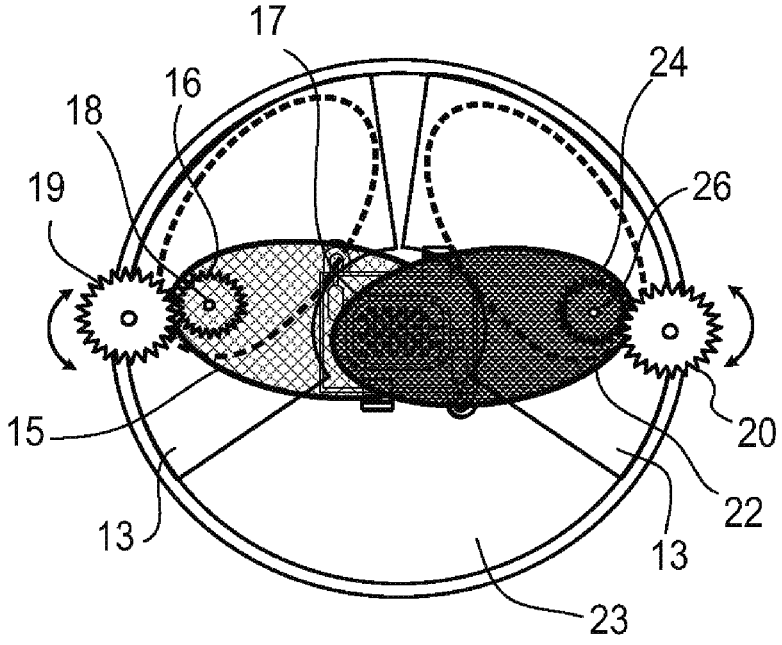
Figure 3A:
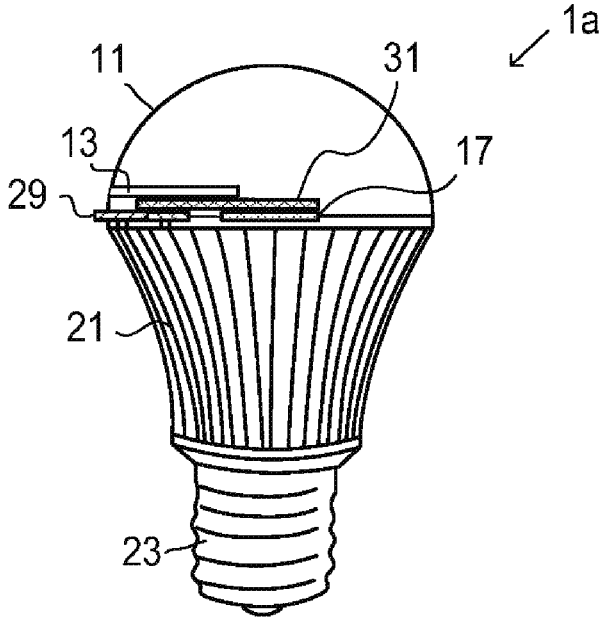
FIGS. 3A and 3B show an LED illumination device according to a second embodiment of the present invention.
Figure 3B:
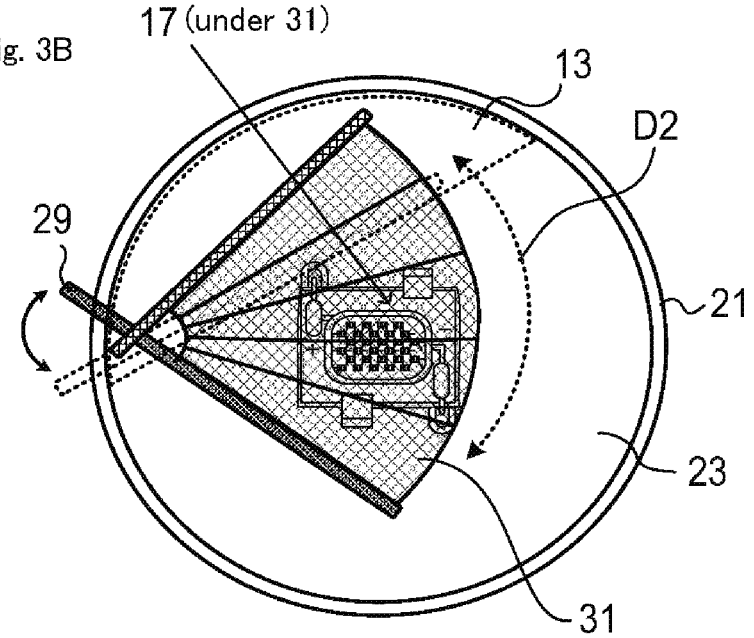

According to a modification of the present embodiment, an illumination device having a dimming function in addition to the toning function is realized by including a light reducing plate 22, a light reducing plate moving gear 24, and an adjustment gear 20, in addition to the fluorescent-substance plate 15 (see FIG. 2). The light reducing plate 22 and the light reducing plate moving gear 24 correspond to a "dimming unit", and the adjustment gear 20 corresponds to a "dimming adjusting unit".

Similarly to the case of the fluorescent-substance plate 15, the light reducing plate 22 is integrated with the light reducing plate moving gear 24 with a fixing shaft 26, so that when the adjustment gear 20 is rotated, the light reducing plate moving gear 24 rotates therewith in the opposite direction with the fixing shaft 26 as the center. The light reducing plate 22 also rotates with the rotation of the light reducing plate moving gear 24. The light reducing plate 22 and the light reducing plate moving gear 24 are completely positioned on the inner side of the case unit 21, and the adjustment gear 20 is partially projected to the outer side of the case unit 21.

When the relative positional relationship between the light reducing plate 22 and the LED light source 17 changes, the region in which the light is blocked by the light reducing plate 22 increases, and as a result, the amount of light radiated from the illumination device 1 to the outside is reduced. Therefore, by touching the portion of the adjustment gear 20 projected to the outer side and rotating the adjustment gear 20, the amount of light radiated from the illumination device 1 is adjusted and the dimming function is realized. The light reducing plate 22 may have a configuration provided with gradation such that the transmissivity changes according to the area on the plate, whereby the dimming function is realized.

In FIG. 2, the adjustment gear 20 is provided on the side opposite to the adjustment gear 19, but the adjustment gear 20 may be shifted in the vertical direction on the same side as the adjustment gear 19.

According to another modification, a plurality of fluorescent-substance plates 15 having different color modes may be arranged. This enables fine toning. In this case, in order to rotate the respective fluorescent-substance plates 15, the adjustment gear is required for each fluorescent-substance plate 15.

[Second Embodiment]

In the present embodiment and the embodiments described below, only the aspect different from the first embodiment will be described, and the description on the common aspect will be omitted.

The present embodiment and the embodiments described below differ from the first embodiment in terms of the specific structure of the variable color fluorescent-substance unit and the toning adjusting unit.

In comparison with the illumination device 1 of the first embodiment, an illumination device la of the present embodiment has a configuration including a fluorescent-substance accordion 31 in place of the fluorescent-substance plate 15, and an adjustment lever 29 in place of the adjustment gear 19. In the present embodiment, the fluorescent-substance accordion 31 serves as the "variable color fluorescent-substance unit", and the adjustment lever 29 serves as the "toning adjusting unit".

The fluorescent-substance accordion 31 is configured by a plurality of small regions that can be folded into a fan-shape, and the small regions of the fluorescent-substance accordion 31 can be folded or the folded small regions can be opened by moving the adjustment lever 29 in the horizontal direction. Also in the present embodiment, the different color distributions corresponding to the area are realized by making the mixing ratios of the fluorescent substances differ according to each area in a state where the fluorescent-substance accordion 31 is opened.

In other words, when the toning is performed, the adjustment lever 29 is moved to open the fluorescent-substance accordion 31, and the relative positional relationship between the LED light source 17 and the color distribution on the fluorescent-substance accordion 31 is changed. When the toning is not performed, the adjustment lever 29 is moved to completely close the fluorescent-substance accordion 31. Accordingly, a fluorescent-substance accommodating region at the time of not performing toning thus can be reduced as compared to the case of the first embodiment, and the illumination device la can be reduced in size.

Also in the present embodiment, a configuration may be adopted in which a light reducing accordion (corresponding to "dimming unit") for dimming and an adjustment lever (corresponding to "dimming adjusting unit") for folding and opening the light reducing accordion are separately and additionally arranged. A plurality of fluorescent-substance accordions having different color distributions may be arranged. In such a case, the adjustment lever for operating the accordion may be provided as many as the number of accordions.

In the present embodiment, the adjustment lever 29 is moved in the horizontal direction, but the moving direction of the adjustment lever 29 is not limited to the horizontal direction as long as the accordion can be opened and folded by the movement of the adjustment lever 29.

[Third Embodiment]

Figure 4A:
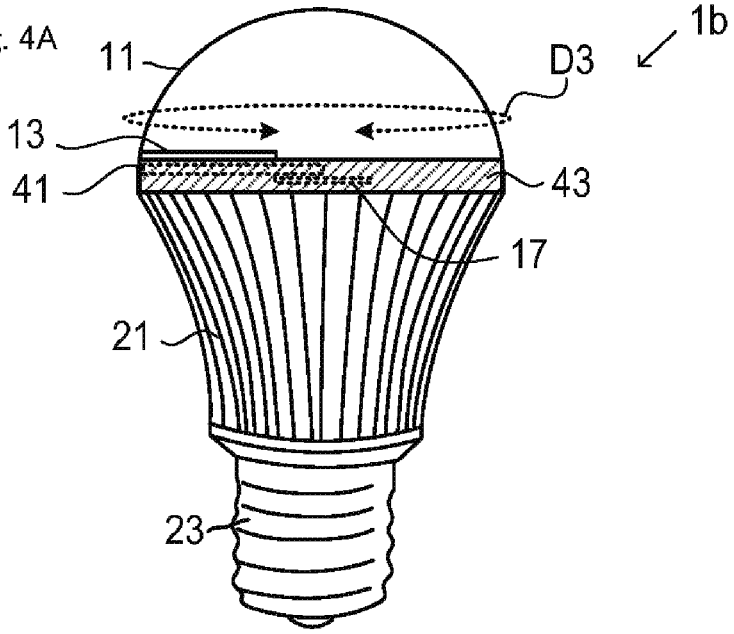
FIGS. 4A and 4B show an LED illumination device according to a third embodiment of the present invention.
Figure 4B:
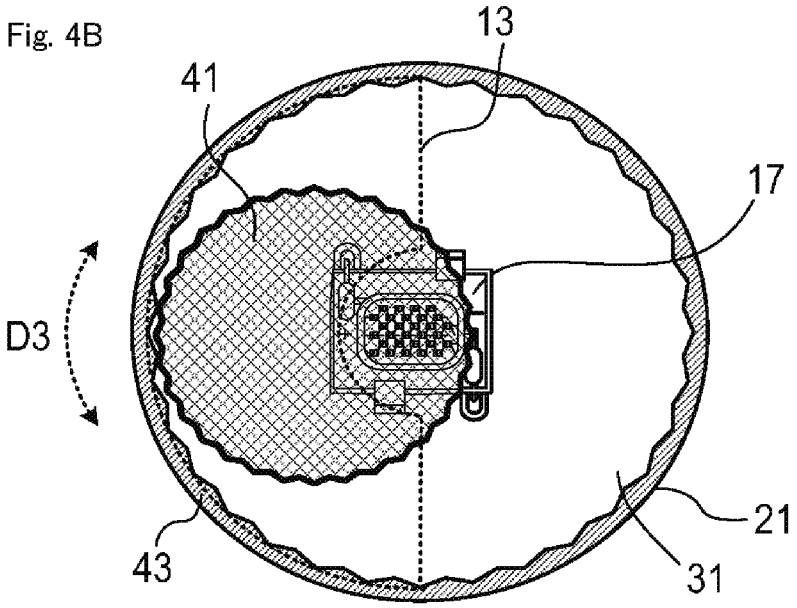

FIGS. 4A and 4B show a schematic structure of an illumination device of a third embodiment. FIG. 4A is a front view and FIG. 4B is a top view of a light source portion.

In comparison with the first embodiment, an illumination device lb of the present embodiment includes, in place of the fluorescent-substance plate 15, a (external gear-shaped) fluorescent-substance plate 41 having a substantially circular plate shape and having gear-shaped irregularities on the outer peripheral portion. Moreover, an adjustment ring 43 that can be rotated in the clockwise direction or the counterclockwise direction is arranged in place of the adjustment gear 19. The adjustment ring 43 is arranged to be positioned on the outer periphery of the main body at a lower side position of the lens dome 11. In the present embodiment, the fluorescent-substance plate 41 serves as the "variable color fluorescent-substance unit", and the adjustment ring 43 serves as the "toning adjusting unit".

The adjustment ring 43 has a (internal gear-shaped) circular ring-shaped structure with gear-shaped irregularities on the inner peripheral portion, and is arranged such that the irregularities mesh with the irregularities of the fluorescent-substance plate 41, that is, the internal teeth of the adjustment ring 43 mesh with the external teeth of the fluorescent-substance plate 41. That is, when the adjustment ring 43 is rotated in the D3 direction, the fluorescent-substance plate 41 also rotates therewith. Similarly to the fluorescent-substance plate 15 of the first embodiment, the fluorescent-substance plate 41 may also realize different color distributions according to the area by making the mixing ratio of the fluorescent substances differ according to each area.

According to the present embodiment, the fluorescent-substance plate 41 rotates by rotating the adjustment ring 43, so that the relative positional relationship between the LED light source 17 and the color distribution on the fluorescent-substance plate 41 changes, whereby the toning function can be exhibited. Since the fluorescent-substance plate 41 is completely accommodated in the case unit 21, moisture and dust are not attached to the surface.

Figure 5A:
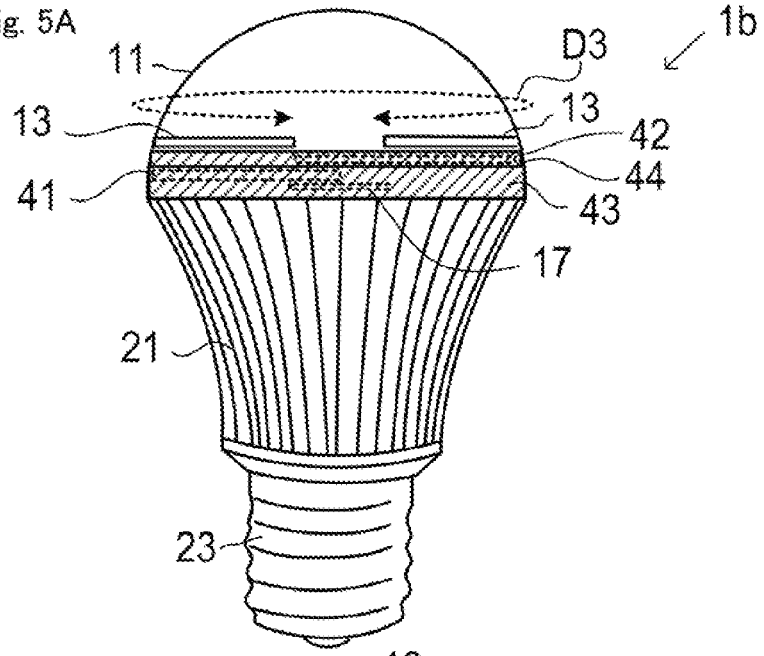
FIGS. 5A and 5B show another configuration example of an LED illumination device according to the third embodiment of the present invention.
Figure 5B:
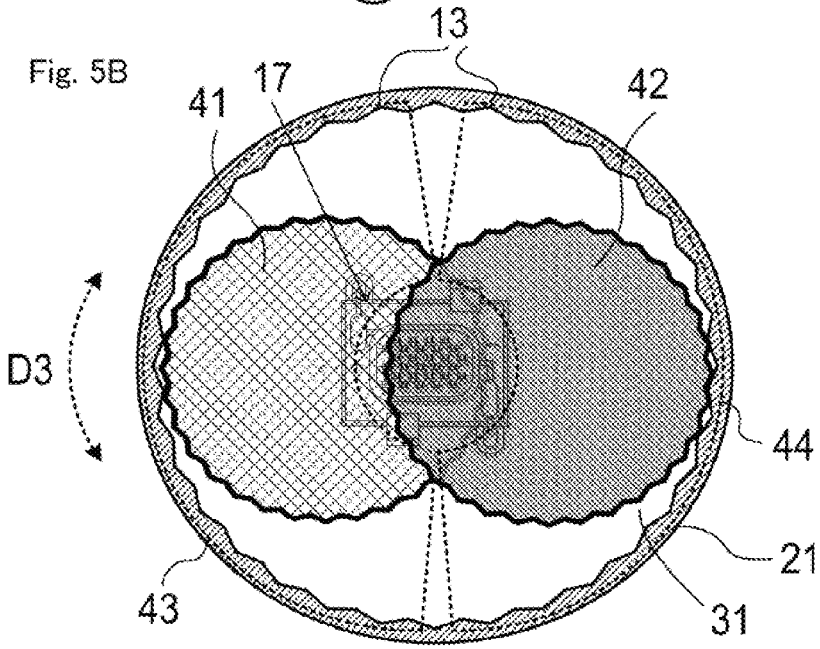

Also in the present embodiment, a plate (light reducing plate) 42 for realizing the dimming function may be arranged (see FIG. 5). In this case, an adjustment ring 44 for rotating the light reducing plate 42 is arranged separately from the adjustment ring 43. In this case, the light reducing plate 42 corresponds to the "dimming unit" and the adjustment ring 44 corresponds to the "dimming adjusting unit".

Alternatively, a plurality of fluorescent-substance plates 41 having different color distributions may be arranged. In this case as well, the adjustment ring 43 may be arranged according to the number of fluorescent-substance plates 41.

[Fourth Embodiment]

Figure 6A:
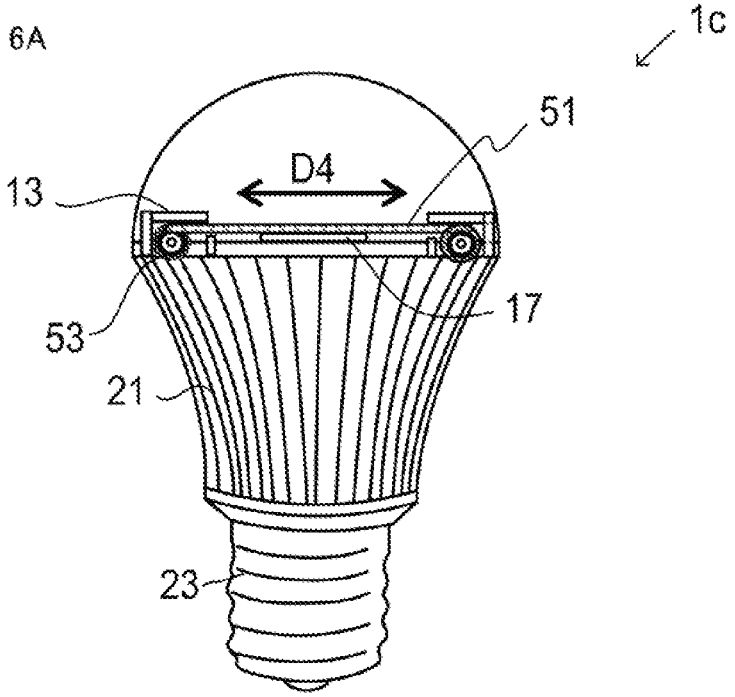
FIGS. 6A and 6B show an LED illumination device according to a fourth embodiment of the present invention.
Figure 6B:
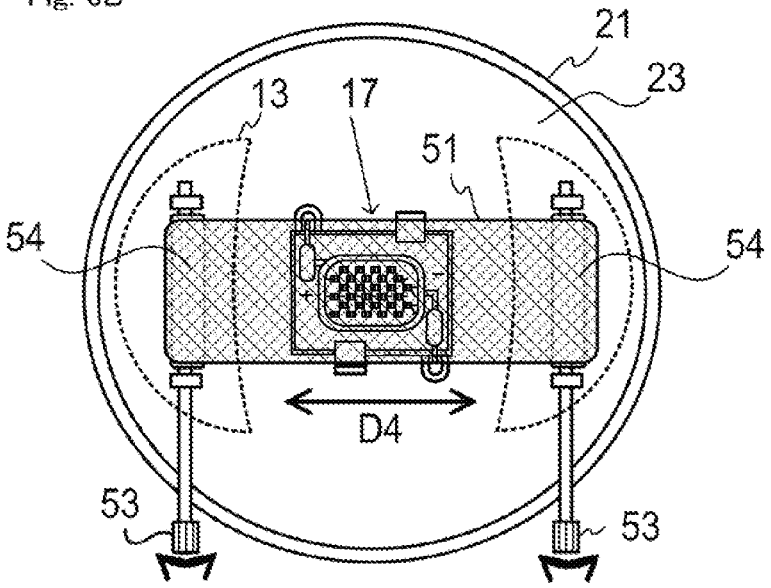

FIGS. 6A and 6B show a schematic structure of an illumination device of a fourth embodiment. FIG. 6A is a front view and FIG. 6B is a top view of a light source portion.

In comparison with the first embodiment, an illumination device 1*c* of the present embodiment includes a fluorescent-substance roll 51 in place of the fluorescent-substance plate 15. Furthermore, an adjustment screw 53 is arranged in place of the adjustment gear 19. A winding unit 54 for coupling the adjustment screw 53 and the fluorescent-substance roll 51 is also arranged. In the present embodiment, the fluorescent-substance roll 51 serves as the "variable color fluorescent-substance unit", and the adjustment screw 53 and the winding unit 54 serve as the "toning adjusting unit".

The fluorescent-substance roll 51 and the winding unit 54 are arranged on the inner side of the case unit 21. The adjustment screw 53 is partially projected to the outer side of the case unit 21 so as to be manually operable.

When the adjustment screw 53 is rotated, the winding unit 54 also rotates with such rotation, and the fluorescent-substance roll 51 is moved therewith in the D4 direction to be wound like a roll screen. As a result, the relative positional relationship between the LED light source 17 and the color distribution on the fluorescent-substance roll 51 changes. The fluorescent-substance roll 51 is similar to the above embodiments in terms of the manner of changing of the color distribution except that the changing direction thereof is in the D4 direction.

By way of example, the mixing ratio of the cerium added fluorescent substance and the europium added fluorescent substance is <<1.1:1>> in the "daylight color" region, <<2:1>> in the "neutral white color" region, <<4:1>> in the "white color" region, and <<5:1>> in the "incandescent lamp color" region, and the mixtures of fluorescent substances in which the mixing ratio is changed in such a manner are successively mixed to silicon resin in this order. Thus, when the adjustment screw 53 is rotated, change can be made in the order of (or in the reverse order of) "daylight color"→"neutral white color"→"white color"→"incandescent lamp color". An Ra value (average color rendering index) in such a configuration is about 90.

According to the present embodiment, the fluorescent-substance roll 51 moves in the D4 direction by rotating the adjustment screw 53, so that the relative positional relationship between the LED light source 17 and the color distribution on the fluorescent-substance roll 51 changes, whereby the toning function can be exhibited. Since the fluorescent-substance roll 51 is completely accommodated in the case unit 21, moisture and dust are not attached to the surface.

Figure 7:
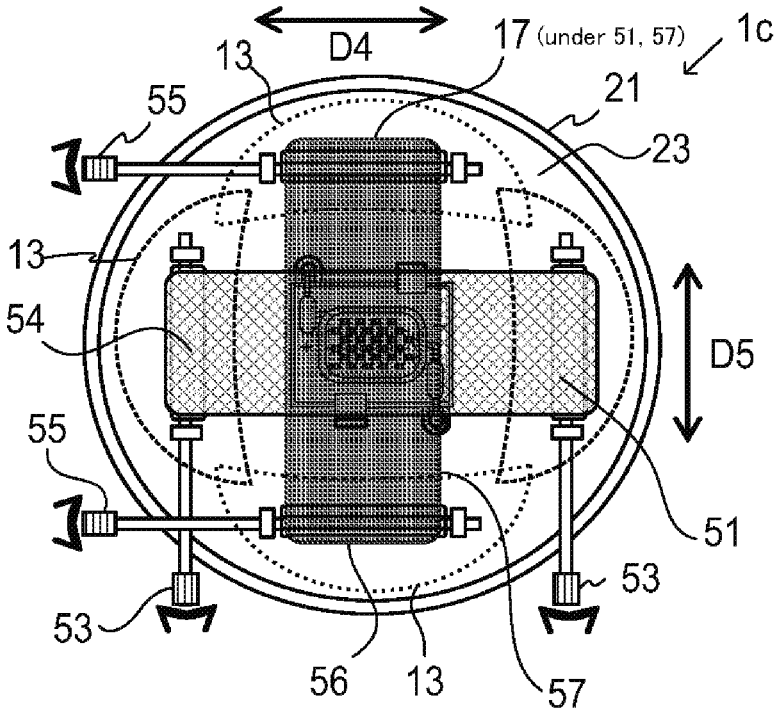
FIG. 7 shows another configuration example of an LED illumination device according to the fourth embodiment of the present invention.
Figure 8A:
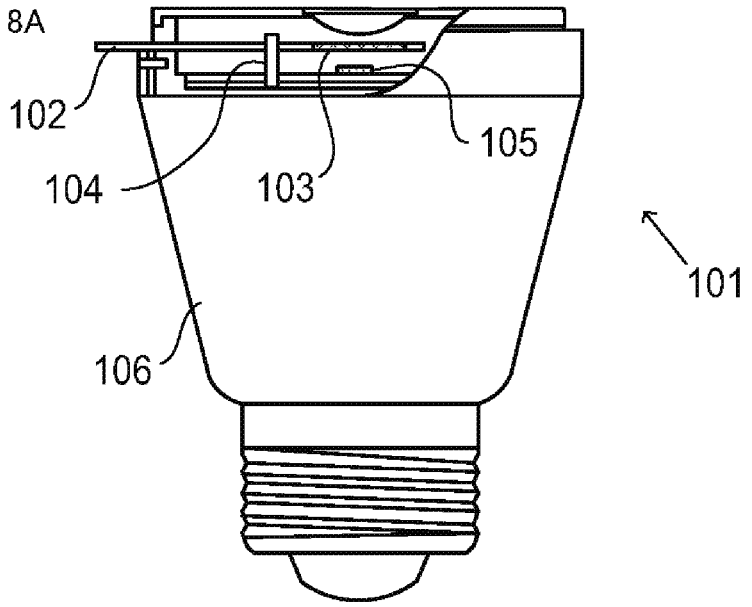
FIGS. 8A and 8B show a conventional LED illumination device.
Figure 8B:
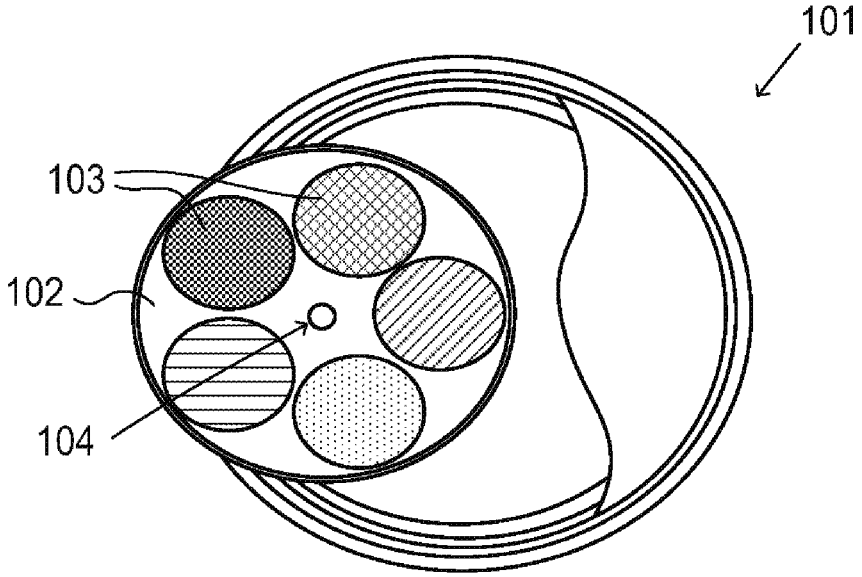

In the present embodiment, a configuration which further includes a light reducing roll 57 for dimming may be adopted as a configuration capable of realizing the toning and dimming function (see FIG. 7). The configuration shown in FIG. 7 includes a light reducing roll 57 that moves in a D5 direction in addition to the fluorescent-substance roll 51 that moves in the D4 direction. A winding unit 56 for winding the light reducing roll 57 and an adjustment screw 55 are also arranged. The light reducing roll 57 corresponds to the "dimming unit" and the adjustment screw 55 and the winding unit 56 correspond to the "dimming adjusting unit". When the adjustment screw 55 is rotated to change the relative positional relationship between the light reducing functioning portion of the light reducing roll 57 and the LED light source 17, the dimming function is realized. The toning and dimming function can be realized by rotating both of the adjustment screws 53 and 55. In FIG. 7, only the top view of the light source portion is shown for the sake of convenience of illustration.

A plurality of fluorescent-substance rolls 51 having different color distributions may be adopted.

[Fifth Embodiment]

Figure 9A:
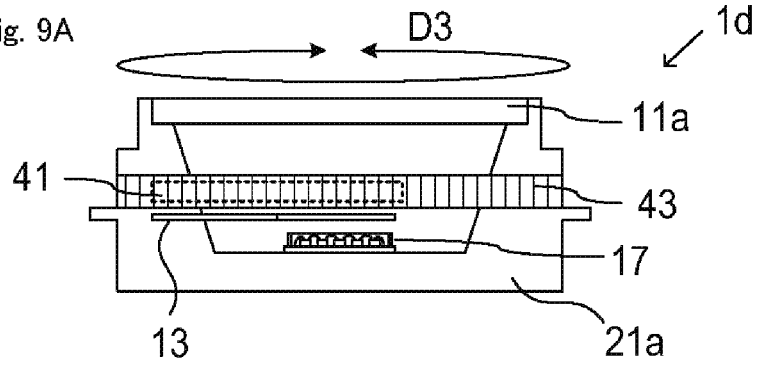
FIGS. 9A and 9B show an LED illumination device according to a fifth embodiment of the present invention.
Figure 9B:
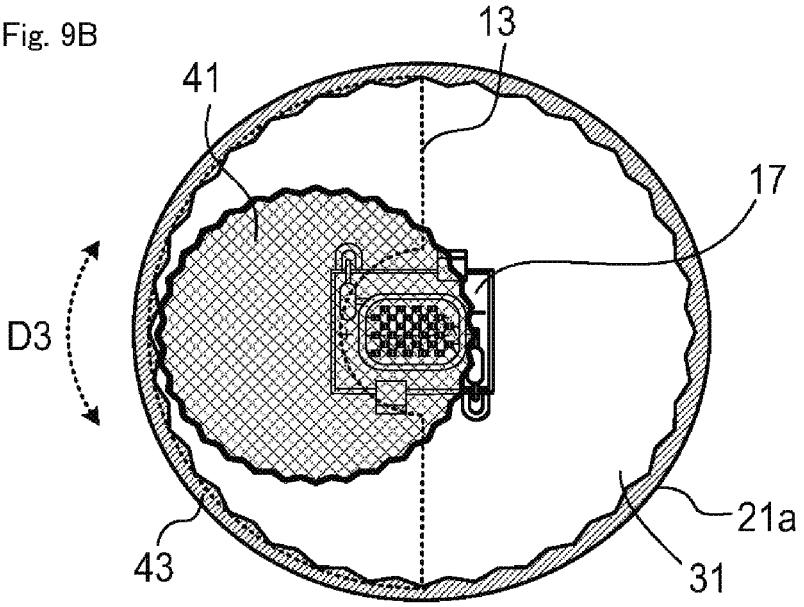

FIGS. 9A and 9B show a schematic structure of an illumination device of a fifth embodiment. FIG. 9A is a front view and FIG. 9B is a top view of a light source portion.

In comparison with the first embodiment, an illumination device ld of the present embodiment is a spotlight type device and includes a flat-shaped lens 11*a* in place of the lens dome 11. Similarly to the third embodiment, the illumination device ld of the present embodiment includes, in place of the fluorescent-substance plate 15, a (external gear-shaped) fluorescent-substance plate 41 having a substantially circular plate shape and having gear-shaped irregularities on the outer peripheral portion. An adjustment ring 43 that can be rotated in the clockwise direction or the counterclockwise direction is arranged in place of the adjustment gear 19. The configuration of the adjustment ring 43 and the fluorescent-substance plate 41 is the same as the third embodiment.

According to the present embodiment, the fluorescent-substance plate 41 rotates by rotating the adjustment ring 43, so that the relative positional relationship between the LED light source 17 and the color distribution on the fluorescent-substance plate 41 changes, whereby the toning function can be exhibited. Since the fluorescent-substance plate 41 is completely accommodated in the case unit 21*a*, moisture and dust are not attached to the surface.

Also in the present embodiment, a plate (light reducing plate 42) for realizing the dimming function may be arranged (not shown). A plurality of fluorescent-substance plates 41 having different color distributions may also be arranged. In this case as well, the adjustment ring 43 may be arranged according to the number of fluorescent-substance plates 41.

According to each of the configurations of the embodiments described above, the fluorescent substance for realizing the dimming function can be completely accommodated on the inner side of the case unit 21. Thus, even if a sealing mechanism or the like is not separately arranged, moisture and dust do not intrude into the fluorescent substance to degrade the toning function.

In all of the embodiments described above, a general light bulb type structure has been illustratively described, but it can be similarly realized with structures of other shapes such as ball type, spotlight type, midget reflector type, chandelier type, and the like. In any of the structures, as long as the variable color fluorescent-substance unit (fluorescent-substance plate 15, fluorescent-substance accordion 31, fluorescent-substance plate 41, fluorescent-substance roll 51) is formed so as not to project to the outer side of the case unit 21, and the adjustment unit (adjustment gear 19, adjustment lever 29, adjustment ring 43, adjustment screw 53) for changing the relative positional relationship between the color distribution of the fluorescent substance applied on the variable color fluorescent-substance unit and the light source is arranged, and an end of the adjustment unit positioned on the side opposite to the variable color fluorescent-substance unit is projected to the outer side of the case unit 21 so as to be easily operable, the structures are all within the assumed scope of the present invention.

EXPLANATION OF REFERENCES

1, 1a, 1*b*, 1*c*: Illumination Device of the present invention
11: Lens Dome
11*a*: Lens
13: Light Reflection Cover
15: Fluorescent-substance Plate
16: Fluorescent-substance Plate Moving Gear
17: LED Light Source
18: Fixing Shaft
19: Adjustment Gear
20: Adjustment Gear
21: Case Unit
21*a*: Case Unit
22: Light Reducing Plate
23: Resin Plate
24: Light Reducing Plate Moving Gear
26: Fixing Shaft
28: Cap
29: Adjustment Lever
31: Fluorescent-substance Accordion
41: Fluorescent-substance Plate
42: Light Reducing Plate
43: Adjustment Ring
44: Adjustment Ring
51: Fluorescent-substance Roll

53: Adjustment Screw
54: Winding Unit
55: Adjustment Screw
56: Winding Unit
57: Light Reducing Roll
101: Conventional Illumination Device
102: Rotation Plate
103: Fluorescent-substance Sheet
104: Shaft
105: LED Element
106: Case

The invention claimed is:

1. An illumination device in which a main body is covered with a case unit, the device comprising:

a light emitting element light source mounted on a substrate on an inner side of the case unit;

a variable color fluorescent-substance unit having a configuration in which a light emitting color of an applied fluorescent substance differs according to position and being arranged above the light emitting element light source on the inner side of the case unit; and a toning adjusting unit mechanically coupled with the variable color fluorescent-substance unit, wherein the variable color fluorescent-substance unit comprises a circular plate shaped gear with external teeth, and is configured to rotate on a fixing shaft provided at a center portion in a clockwise direction or a counterclockwise direction, the toning adjusting unit comprises a circular ring-shaped gear with internal teeth which couples to an outer periphery of the case unit and is rotatable in the clockwise direction or the counterclockwise direction, the variable color fluorescent-substance unit is arranged such that the external teeth mesh with the internal teeth of the toning adjusting unit, and a relative positional relationship between a color distribution of the fluorescent substance applied on the variable color fluorescent-substance unit and the light emitting element light source is changed when the toning adjusting unit is rotated to rotate the variable color fluorescent-substance unit.

2. The illumination device according to claim 1, comprising a dimming unit for adjusting an amount of light actually radiated outside the illumination device with respect to an amount of light radiated from the light emitting element light source; and a dimming adjusting unit mechanically coupled to the dimming unit, wherein the dimming unit comprises a circular plate shaped gear with external teeth, and is configured to rotate on a fixing shaft provided at a center portion in a clockwise direction or a counterclockwise direction, the dimming adjusting unit comprises a circular ring-shaped gear with internal teeth which couples to an outer periphery of the case unit and is rotatable in the clockwise direction or the counterclockwise direction, the dimming unit is arranged such that the external teeth mesh with the internal teeth of the dimming adjusting unit, and a relative positional relationship between the dimming unit and the light emitting element light source is changed when the dimming adjusting unit is rotated to rotate the dimming unit.

3. The illumination device according to claim 1, comprising a plurality of variable color fluorescent-substance units, each corresponding to the variable color fluorescent-substance unit, in which the color distribution of the applied fluorescent substance differs from each other, wherein the variable color fluorescent-substance units are mechanically coupled to different toning adjusting units, respectively, the different toning adjusting units each corresponding to the toning adjusting unit.

* * * * *